US005978995A

United States Patent [19]

Bruntz et al.

[11] Patent Number: 5,978,995

[45] Date of Patent: Nov. 9, 1999

[54] INFINITE TEMPERATURE CONTROL

[75] Inventors: Jordan S. Bruntz, Baxter; Scott E. Griffith, Newton, both of Iowa

[73] Assignee: Maytag Corporation, Newton, Iowa

[21] Appl. No.: 09/098,910

[22] Filed: Jun. 17, 1998

[51] Int. Cl.[6] ..... D06F 39/08

[52] U.S. Cl. ..... 8/158; 68/12.19; 68/12.22; 68/207

[58] Field of Search ..... 8/158, 12.19, 12.21, 8/12.22, 12.27, 207; 236/12.12

[56] References Cited

U.S. PATENT DOCUMENTS

| | | | |
|---|---|---|---|
| 2,321,573 | 6/1943 | Chace | 68/12.19 X |
| 2,425,788 | 8/1947 | Edwards | 68/12.19 |
| 2,548,651 | 4/1951 | Chace et al. | 68/207 X |
| 4,031,911 | 6/1977 | Frazar . | |
| 4,147,297 | 4/1979 | Worst . | |
| 4,267,711 | 5/1981 | Kolze . | |
| 4,503,575 | 3/1985 | Knoop et al. . | |
| 4,528,709 | 7/1985 | Getz et al. . | |
| 4,541,562 | 9/1985 | Zukausky . | |
| 4,643,350 | 2/1987 | DeSchaaf et al. . | |
| 4,978,058 | 12/1990 | Duncan et al. . | |
| 5,033,671 | 7/1991 | Shiba et al. . | |
| 5,067,333 | 11/1991 | Duncan et al. . | |
| 5,231,722 | 8/1993 | Shacklock et al. . | |
| 5,251,667 | 10/1993 | Kunz et al. . | |
| 5,255,844 | 10/1993 | Miller et al. . | |

*Primary Examiner*—Philip R. Coe
*Attorney, Agent, or Firm*—Zarley, McKee, Thomte, Voorhees & Sease

[57] ABSTRACT

An infinite temperature control system is used to control the temperature of wash and rinse water in a washing machine. The invention includes a temperature selection switch which operates the water valves for controlling the temperature of water entering the washing machine. The switch has an infinite number of possible temperature settings and includes various contacts for affecting various aspects of the water temperature control.

17 Claims, 5 Drawing Sheets

INFINITE TEMPERATURE CONTROL

BACKGROUND OF THE INVENTION

1. Field of the Invention

The present invention relates to washing machines. More particularly, though not exclusively, the present invention relates to a method and apparatus for controlling the water temperature in a washing machine.

2. Problems in the Art

Controlling the temperature of wash water and rinse water in a washing machine has been used for years to wash clothing in an effective and efficient manner. For example, when washing clothing having bright colors, colder water temperatures are typically desired. When washing white clothing, hotter water temperatures are typically desired.

A typical prior art washing machine includes a water temperature selector on a control panel. Temperature selectors usually include a number of discrete settings for wash/rinse temperatures such as WARM/WARM, HOT/COLD, WARM/COLD, and COLD/COLD, for example. A user is therefore limited to these predetermined discrete water temperature settings.

FEATURES OF THE INVENTION

A general feature of the present invention is the provision of a method and apparatus for providing a water temperature control system for a washing machine which overcomes problems found in the prior art.

A further feature of the present invention is the provision of a method and apparatus for providing a water temperature control system for a washing machine which provides a user with an infinite number of temperature settings from which to choose.

Further features, objects and advantages of the present invention include:

A method and apparatus for providing a water temperature control system for a washing machine which allows a user to choose from an infinite number of wash water temperatures while limiting the rinse water temperature to a desired range.

A method and apparatus for providing a water temperature control system for a washing machine which disables the hot water valve under certain circumstances.

A method and apparatus for providing a water temperature control system for a washing machine which utilizes a slide potentiometer and timing circuit to create an infinite temperature control.

A method and apparatus for providing a water temperature control system for a washing machine having a temperature selector which guarantees full hot and full cold temperatures at extreme settings.

A method and apparatus for providing a water temperature control system for a washing machine which uses pulse width modulation to control the water temperature.

These as well as other features, objects and advantages will become apparent from the following specification and claims.

SUMMARY OF THE INVENTION

The temperature control system of the present invention is used to control the temperature of water used in a washing machine. The invention is comprised of a user adjustable temperature selection switch which is operatively coupled to the water valve for controlling the temperature of water entering the washing machine. The temperature selection switch has a substantially infinite number of possible temperature settings. The temperature selection switch may also include various contacts for affecting various aspects of the water temperature control.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
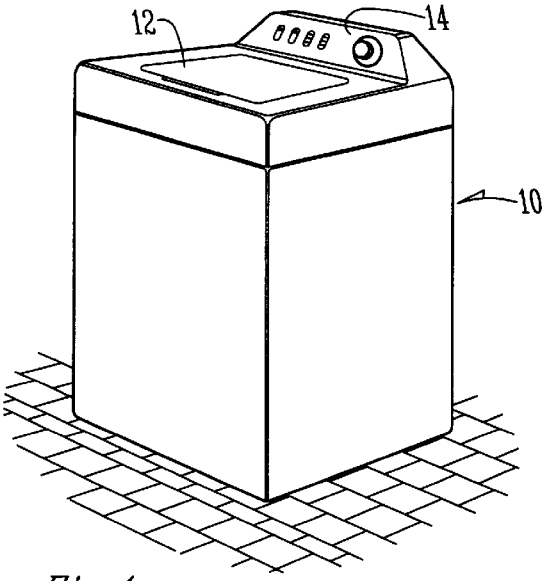
FIG. 1 is a perspective view showing a washing machine of the present invention.

FIG. 1 is a perspective view of a washing machine 10 of the present invention. As shown, the washing machine 10 includes a door 12 which provides access to the interior of the washing machine 10. Disposed within the washing machine 10 is a conventional wash tub and agitator (not shown). The washing machine 10 also includes a control panel 14 which allows a user to control the various functions of the washing machine 10.

Figure 2:
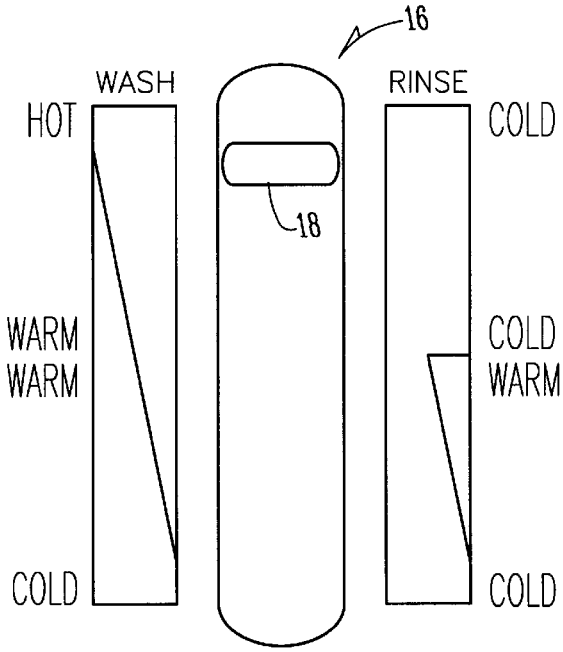
FIG. 2 is a view of the temperature selector of the present invention.

FIG. 2 is an enlarged view of a temperature control selector 16 which is a part of the control panel 14 shown in FIG. 1. The temperature control selector 16 includes a slider switch 18 which is described in more detail below. To the left of the slider switch 18 is indicia providing the user with a guide of the wash temperature selected. As shown, as the slider switch 18 is moved up and down, a wash temperature can be selected between hot and cold. The temperature control selector 16 also includes indicia on the right side which provides the user with an indication of the rinse water temperature selected. As shown, a rinse temperature can be selected between cold and warm. The operation of the slider switch 18 in conjunction with the indicia shown in FIG. 2 is described in detail below.

Figure 3:
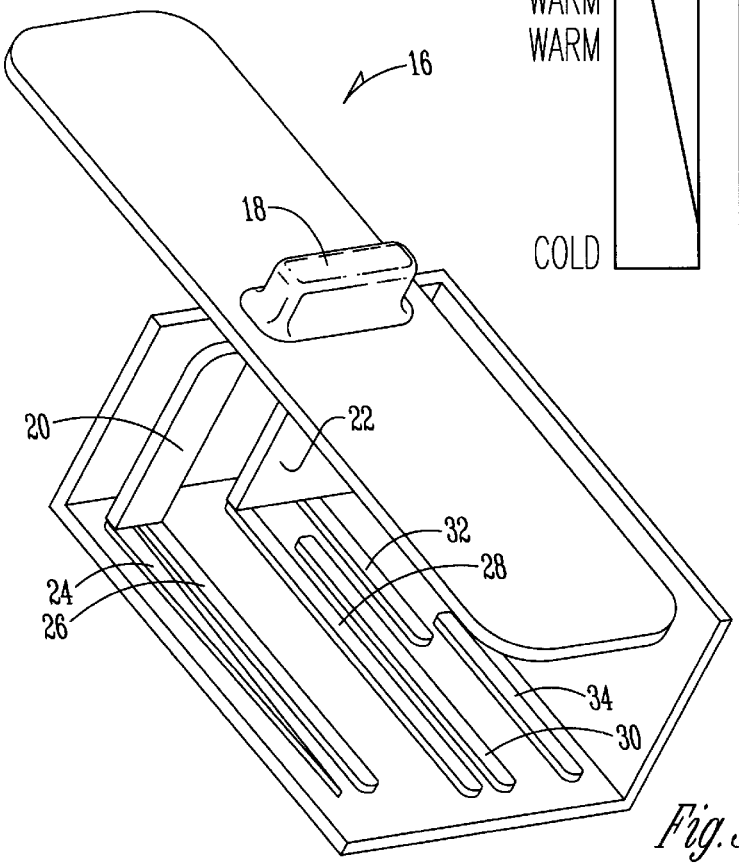
FIG. 3 is a perspective view of the temperature selector of the present invention.

FIG. 3 is a perspective view of the temperature control selector 16 shown in FIG. 2. As shown, the slider switch 18 is coupled to a first wiper 20 and a second wiper 22. When the slider switch 18 is moved up or down, the wipers 20 and 22 move with the slider switch 18. The first wiper 20 makes electrical contact with first and second conductive strips 24 and 26. The wipers 20 and 22 are electrically conductive and provide a short between the strips which they contact. A first strip 24 is a resistant strip having a varying width, and therefore a varying resistance, depending on the position of the wiper 20. In the preferred embodiment, the resistive strip 24 varies from 80kΩ to 580kΩ. The second wiper 22 makes electrical contact with two or more of the third, fourth, fifth and sixth conductive strips 28, 30, 32, and 34 respectively. As the slider switch 18 is moved up and down, the second wiper 22 shorts various combinations of the conductive strips 28, 30, 32, and 34 together as described in more detail below.

In an alternate embodiment, detents can be provided in the slider switch 18 to accurately locate certain positions. In addition, the slider switch 18 can be comprised of a rotary switch.

Figure 4:
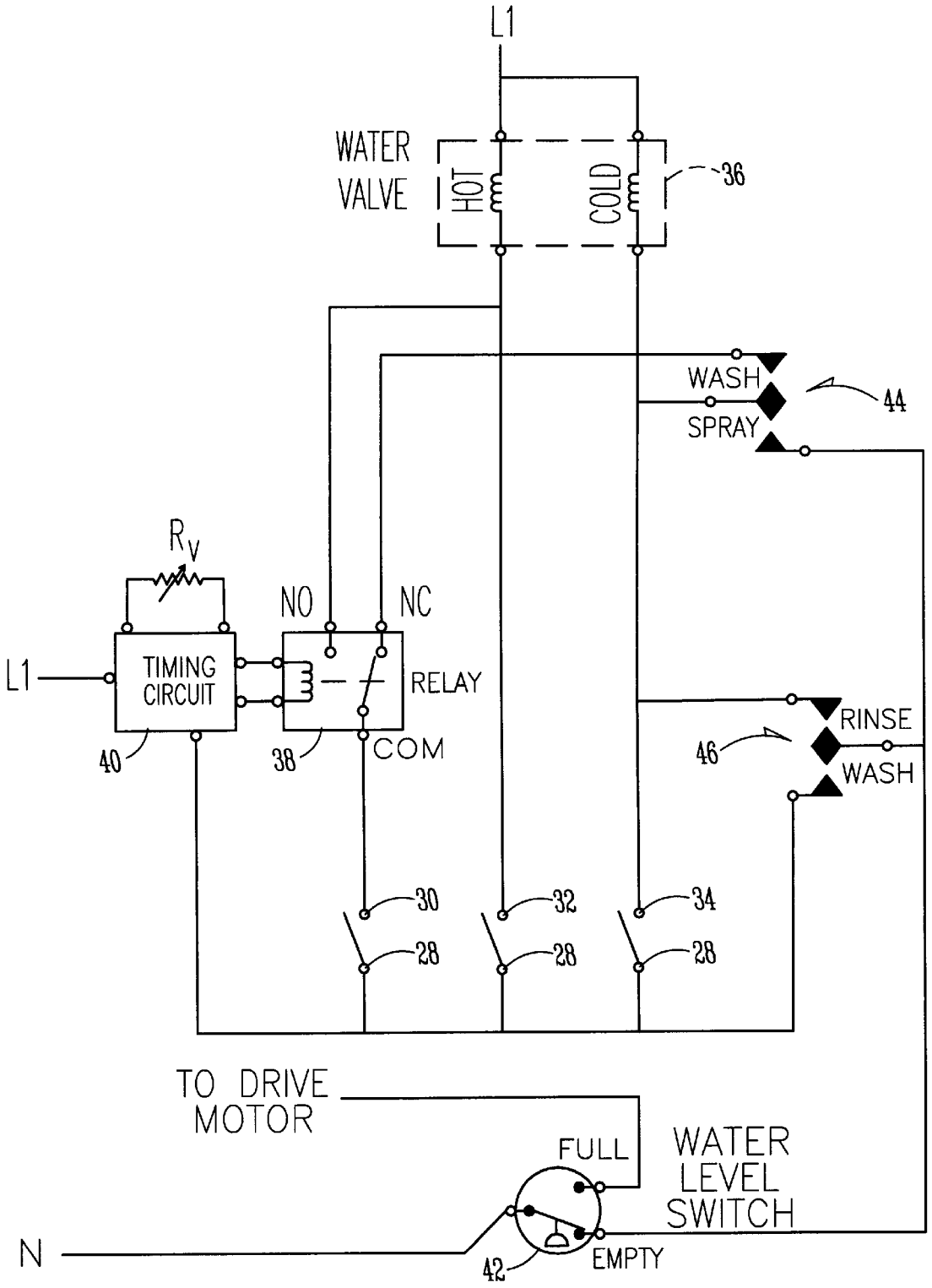
FIG. 4 is an electrical schematic diagram of the control system of the present invention.

FIG. 4 is an electrical schematic diagram of the control system of the present invention. FIG. 4 illustrates how the slider switch 18 is used to control the temperature of the wash and rinse water. The main components of the control system include a water valve 36, a relay 38, a timing circuit 40, a water level switch 42, and timer cams 44 and 46. Note that the water valve 36 may be comprised of separate individual valves or a single valve capable of controlling both the hot and cold water. The diagram of FIG. 4 also illustrates how the various conductive strips of the temperature control selector 16 are incorporated into the control system. The timing circuit 40 (described in detail below) makes a connection to a variable resistor $R_v$. The variable resistor $R_v$ is comprised of the combination of the conductive strips 24 and 26 shown in FIG. 3. As mentioned above, the resistance of the variable resistor $R_v$ is varied depending on the position of the wiper 20 relative to the conductive strips 24 and 26. The timing circuit 40 electrically controls the relay 38 depending on the state of the timing circuit 40. FIG. 4 also shows the effect of the wiper 22 when it shorts the various conductive strips 28, 30, 32, and 34 together, as is described in detail below.

Figure 5:
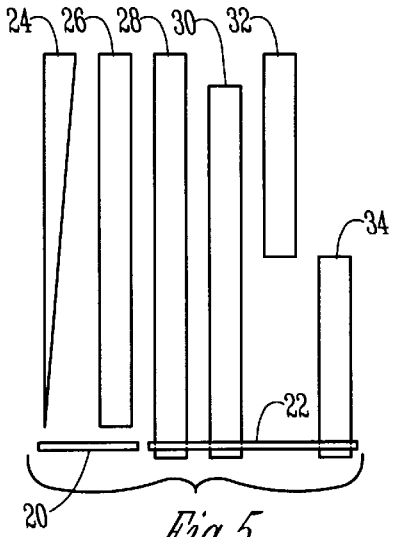
FIGS. 5–9 show the possible positions of the temperature selector of the present invention.

FIGS. 5–9 illustrate the various possible positions of the slider switch 18 relative to the conductive strips 24, 26, 28, 32, and 34. The operation of the control system illustrated in FIG. 4 will be described using FIGS. 5–9. When the slider switch 18 is at its lower most position, the wipers 20 and 22 will be positioned as shown in FIG. 5. In this position, the variable resistor $R_v$ is open since conductive strips 24 and 26 are not shorted together. In this position, the timing circuit 40 will never energize the relay 38. As shown in FIG. 5, the conductive strips 28, 30, and 34 are shorted together which allows the cold valve to be turned on continuously. The result of this setting is full cold wash water, which matches the indicia shown in FIG. 2.

Figure 6:
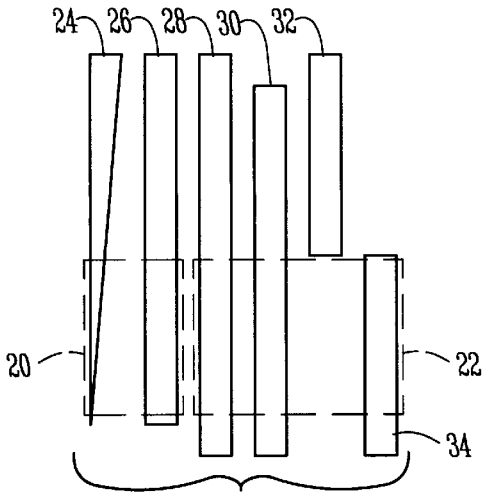

FIG. 6 illustrates the possible positions of the wipers 20, 22 between the lower most position and just below the halfway position. In FIG. 6, the wipers 20 and 22 are shown by an enlarged dashed box to illustrate the range of possible positions. The wipers 20 and 22 can be positioned in an infinite number of positions within the dashed box. In this range, the variable resistor VR allows the timing circuit 40 to cycle which results in a pulsed signal being sent to the relay 38. As a result, the hot valve is pulsed. The cold valve is also turned on as a result of the short between contacts 28 and 34. The result is cold alternating with warm wash water. As the slider 20 approaches the upper portion of the range illustrated in FIG. 6, the value of the variable resistor $R_v$ decreases, resulting in an increase of relay on time and a warmer temperature.

Figure 7:
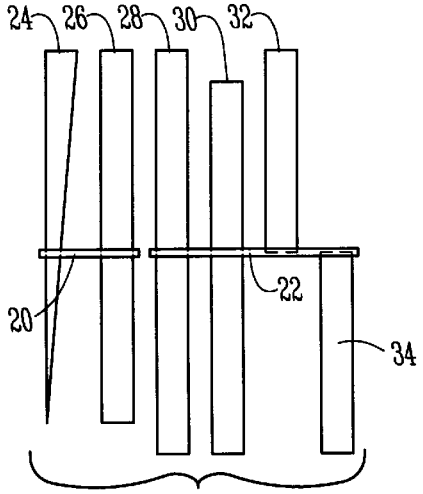

FIG. 7 illustrates the slider switch 18 in the center position. In this position, the cold valve is held on by the short between the conductive strips 28 and 34. In addition, the hot valve is held on by the short between conductive strips 28 and 32. The timing circuit 40 will continue to cycle but will have no effect because of the short between conductive strips 28 and 32. The result is 100% warm wash water as indicated by the indicia in FIG. 2.

Figure 8:
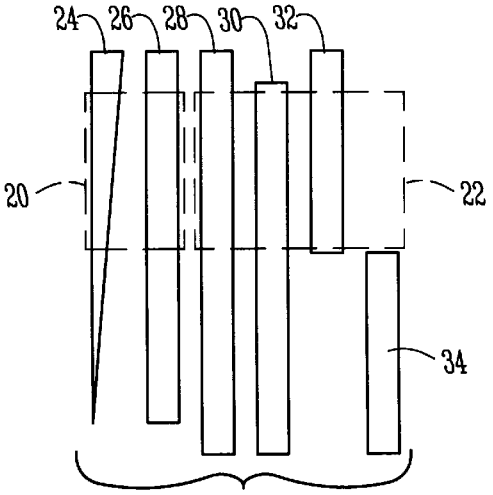
Figure 9:
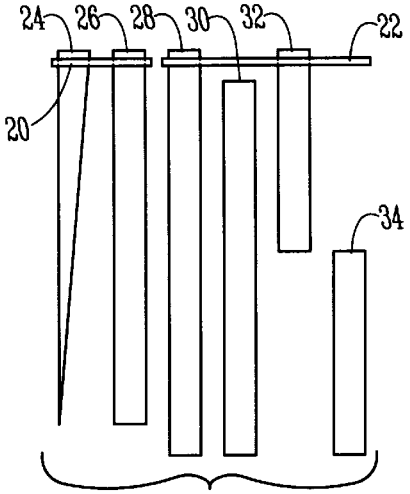

FIG. 8 illustrates the range of positions of the wipers 20 and 22 just above the center position (FIG. 7) to just below the upper most position (FIG. 9). In this position, the hot valve is held on by the shorting of the conductive strips 28 and 32. The cold valve is no longer held on because the conductive strips 28 and 34 are no longer shorted. In this position the timing circuit 40 will pulse the cold valve. The result is warm alternating with hot wash water.

FIG. 9 shows the wipers 20 and 22 in their upper most position. In this position, the hot valve is held on by the short between conductive strips 28 and 32. The timing circuit 40 continues to pulse, but has no effect because the conductive strips 28 and 30 are no longer shorted together. The result is full hot wash water.

It can be seen that the wash water temperature of the washing machine 10 can be infinitely varied between a full cold and a full hot temperature. Because of the infinite number of possible positions of the wipers 20, 22, an infinite number of temperature settings can be achieved.

The rinse water temperature of the present invention operates in a manner similar to the wash water temperature described above. A primary difference is that when a temperature above warm is selected (FIGS. 8 and 9) the hot valve is disabled. The hot valve is disabled by the timer cams 44 and 46 since the cams 44 and 46 only allow cold water unless the conductive strips 28 and 34 are shorted together, which never happens when a wash temperature above warm is selected.

The control system is designed to prevent hot water from being added when a setting lower than warm is selected. This eliminates bright colored clothing from being damaged by hot water.

Figure 10:
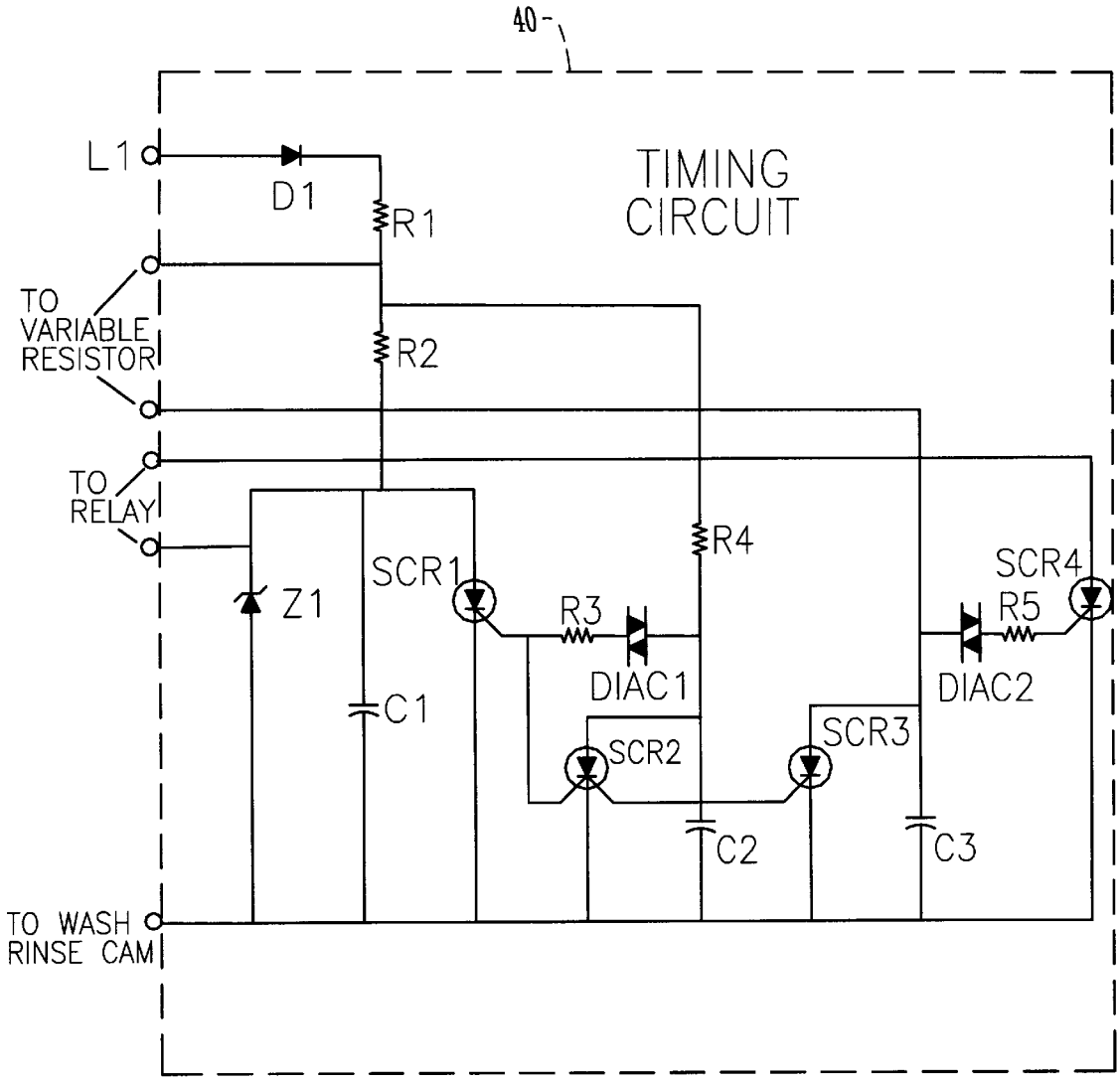
FIG. 10 is an electrical schematic diagram of the timing circuit shown in FIG. 4.

FIG. 10 is an electrical schematic diagram of the timing circuit 40 shown in FIG. 4. In the timing circuit 40, a DC power supply is provided by a diode D1, resistor R1, resistor R2, capacitor C1, and zener diode Z1. When power is applied to the timing circuit 40, the capacitor C3 begins charging through the variable resistor $R_v$. When the voltage across the capacitor C3 reaches 35 volts, the diac DIAC2 conducts and gates the silicon controlled rectifier SCR4 through resistor R5. When this happens, the relay 40 is activated. While capacitor C3 is charging, capacitor C2 also charges through resistor R4. When the voltage across capacitor C2 reaches 35 volts, the diac DIAC1 conducts and gates the silicon controlled rectifiers SCR1, SCR2, and SCR3. This discharges the capacitors C2 and C3 and the timing sequence described above begins again. At this time, the relay coil is shorted and the current through the coils is not sufficient to hold silicon controlled rectifier SCR4 on.

Note that as the variable charge rate of $R_v$C3 approaches the fixed rate of R4C2, the on time of the relay 38 approaches 0 seconds. The frequency of the timing circuit 40 is fixed by R4C2, and the pulse width is set by $R_v$C3. The timing circuit 40 is therefore a pulse width modulator.

Figure 13:
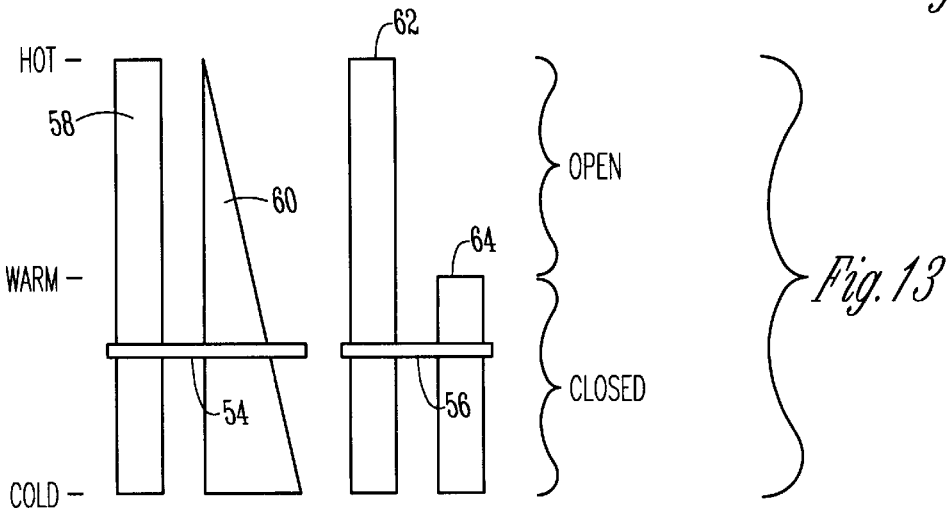
FIG. 13 shows the possible positions of the temperature selector in an alternate embodiment of the present invention.
Figure 11:
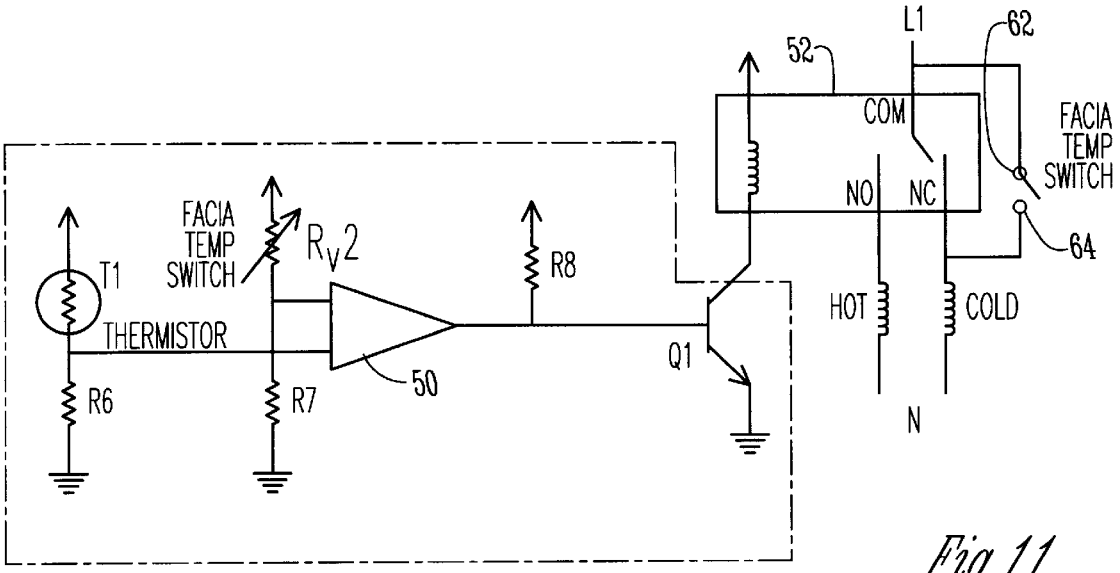
FIGS. 11 and 12 are electrical schematic diagrams of an alternative embodiment of the present invention.
Figure 12:
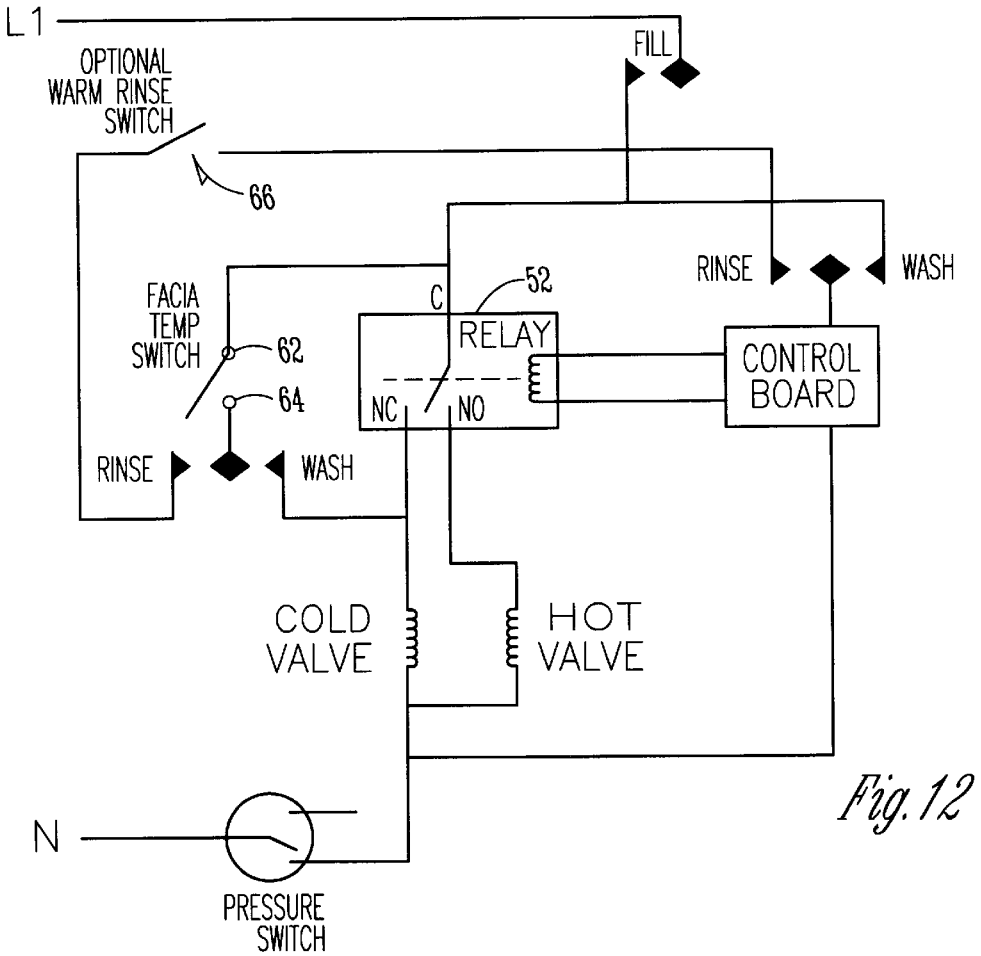

FIGS. 11–13 illustrate an alternative embodiment to the present invention. The alternative embodiment uses the temperature control circuit shown in FIG. 11 to regulate the water temperature in the washing machine 10. The temperature control circuit uses a thermistor T1 to monitor the water temperature in the tub of the washing machine 10. A comparitor 50 compares the voltage at the thermistor T1 with a reference voltage which depends on the value of $R_{v2}$. The value of $R_{v2}$ depends on the position of wiper 54 relative to conductive strips 58 and 60. As a result, the reference voltage varies depending on the position of the slider switch. The comparator 50 and its associated components switches power between the hot and cold valve by either energizing or not energizing a relay 52. The schematic diagram of FIG. 12 illustrates how the temperature control circuit shown in FIG. 11 helps to regulate the temperature of the water in the washing machine 10. The portion of the circuit enclosed by dashed lines in FIG. 11 is included within the control board shown in FIG. 12. The alternate embodiment includes a slider switch similar to the slider switch 18 shown in FIGS. 2 and 3. The slider switch includes a first and a second wiper 54 and 56 as shown in FIG. 13. The wiper 54 shorts first and second conductive strips 58 and 60 together in a way similar to the manner in which wiper 20 shorts conductive strips 24 and 26 together as described above. The second wiper 56 provides a short between third and fourth conductive strips 62 and 64 when the selector switch is positioned between the cold and warm positions. As shown, the conductive strips 62 and 64 are closed when the user selects a temperature between warm and cold. As shown in FIGS. 11 and 12, the conductive strips 62 and 64 are connected to the cold valve and only allow cold water or warm water to enter the wash tub when the conductive strips 62 and 64 are shorted or closed. This concept could also be used to provide a guaranteed cold temperature.

An optional warm rinse switch 66 is shown in FIG. 12. When the warm rinse switch 66 is closed, the control board will be turned on during the rinse cycle.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A temperature control system for a washing machine having at least one water valve for allowing the washing machine to be filled with water comprising:

a user adjustable temperature selection switch operatively coupled to the at least one water valve for controlling the temperature of water entering the washing machine, wherein the temperature selection switch has a substantially infinite number of possible temperature settings.

2. The apparatus of claim 1, wherein the temperature selection switch further comprises a variable resistor.

3. The apparatus of claim 2, further comprising:

a relay operatively connected to the at least one water valve for controlling the operation of the water valve; and a timing circuit electrically connected to the variable resistor and to the relay for controlling the operation of the relay depending on the value of the variable resistor.

4. The apparatus of claim 3, wherein the relay receives a control signal from the timing circuit which determines the temperature of the water entering the washing machine.

5. The apparatus of claim 4 wherein the control signal is a pulse width modulated signal.

6. The apparatus of claim 1 wherein the control system includes a substantially infinite number of wash temperature settings between hot and cold.

7. The apparatus of claim 1 wherein the control system includes a substantially infinite number of rinse temperature settings between warm and cold.

8. The apparatus of claim 1 wherein the temperature selection switch includes at least one secondary switch which allows full hot and full cold temperature settings.

9. The apparatus of claim 1 wherein the temperature selection switch includes at least one secondary switch which prevents a hot or warm rinse if a hot wash is selected.

10. The temperature control system of claim 1, further comprising:

a temperature sensor for sensing the temperature of water in the washing machine; and a circuit operatively connected to the temperature sensor for adjusting the temperature of the water entering the washing machine.

11. The temperature control system of claim 10 wherein the temperature sensor is comprised of a thermistor.

12. The temperature control system of claim 1 wherein the selection switch includes a secondary switch which prevents hot wash water from entering the washing machine when the selection switch is positioned to select a warm or cold wash temperature.

13. A method of controlling the temperature of water used by a washing machine comprising the steps of:

providing at least one water valve for allowing hot and cold water to fill the washing machine;

providing a control switch having a substantially infinite number of operating positions;

selecting a desired temperature by actuating the control switch to a desired position; and adjusting the at least one water valve to fill the washing machine with water having a temperature determined by the desired position of the control switch.

14. The method of claim 13 further comprising the step of providing the control switch with a variable resistor, wherein the adjustment of the water valve is made depending on the value of the variable resistor.

15. The method of claim 13 further comprising the steps of:

electrically connecting a relay to at least one water valve for controlling the operation of the water valve;

electrically connecting a timing circuit to the relay for controlling the operation of the relay; and controlling the timing circuit based on the position of the control switch.

16. The method of claim 15, further comprising the step of sending a pulse width modulated signal from the timing circuit to the relay to control the operation of the relay.

17. The method of claim 13 further comprising the step of preventing a hot or warm rinse if a hot wash is selected.

* * * * *